US008920068B1

(12) United States Patent
Free et al.

(10) Patent No.: US 8,920,068 B1
(45) Date of Patent: Dec. 30, 2014

(54) PROCESS FOR SLIP FORMING REINFORCED BRIDGE COPING WITH EXPOSED REBARS

(71) Applicants: Patrick Free, West Palm Beach, FL (US); Eric C. Kontos, Boca Raton, FL (US)

(72) Inventors: Patrick Free, West Palm Beach, FL (US); Eric C. Kontos, Boca Raton, FL (US)

( * ) Notice: Subject to any disclaimer, the term of this patent is extended or adjusted under 35 U.S.C. 154(b) by 0 days.

(21) Appl. No.: 14/071,629

(22) Filed: Nov. 4, 2013

(51) Int. Cl.
*E01D 21/00* (2006.01)
*E01C 19/48* (2006.01)

(52) U.S. Cl.
CPC ..... *E01C 19/4886* (2013.01); *E01D 21/00* (2013.01)
USPC ..... 404/75; 404/101; 404/105; 404/106; 404/108; 14/73; 14/77.1; 425/192 R

(58) Field of Classification Search
CPC ..... E01C 19/4886; E01C 21/00
USPC ..... 404/75, 98, 105, 106, 108; 14/73, 77.1; 425/192 R
See application file for complete search history.

(56) References Cited

U.S. PATENT DOCUMENTS

| | | | | |
|---|---|---|---|---|
| 3,792,133 | A * | 2/1974 | Goughnour | 264/33 |
| 4,084,928 | A * | 4/1978 | Petersik | 425/64 |
| 4,093,410 | A * | 6/1978 | Miller | 425/59 |
| 4,266,917 | A * | 5/1981 | Godbersen | 425/64 |
| 5,290,492 | A * | 3/1994 | Belarde | 264/33 |
| 5,354,189 | A * | 10/1994 | McKinnon | 425/64 |
| 8,573,886 | B1 * | 11/2013 | Taylor, Jr. | 404/98 |
| 2002/0039519 | A1 * | 4/2002 | Piccoli et al. | 404/98 |
| 2010/0129151 | A1 * | 5/2010 | Guntert et al. | 404/72 |
| 2012/0128417 | A1 * | 5/2012 | Zimmermann et al. | 404/72 |

* cited by examiner

*Primary Examiner* — Raymond W Addie
(74) *Attorney, Agent, or Firm* — John H. Faro, Esq

(57) ABSTRACT

A process for slip forming of concrete structures, specifically, concrete structural components, for road and bridge construction. This process has particular application for slip forming of monolithic structures having multiple component/functional parts, wherein the resultant slip formed monolithic, structure has exposed rebars bar the later integration with additional concrete structures arid/or mechanical structural elements, c,g. noise walls, barricades, guard rails and the like. This invention also includes a system adapted for the formation of these unique, monolithic slip formed structures with exposed rebars, including the tunnel mold assembly, which is utilized in this slip forming process; and, the resultant to slip molded monolithic structural component with exposed rebus.

16 Claims, 12 Drawing Sheets

PROCESS FOR SLIP FORMING REINFORCED BRIDGE COPING WITH EXPOSED REBARS

BACKGROUND OF THE INVENTION

1. Field of the Invention

This invention relates to a slip forming process and to the monolithic, reinforced concrete structures produced in accordance with this slip forming process of this invention. More specifically, this invention relates to a process for slip forming reinforced concrete road structures, wherein the resulting slip formed structures have exposed reinforcing bars ("rebars"), which are partially embedded in and extend from within a slip formed, reinforced concrete structure. in one of the preferred embodiment of this invention, this slip forming process utilizes a "tunnel mold assembly" for forming a coping for bridge construction, wherein the coping is preferably formed concurrent with a slip formed concrete road bed pad. In this preferred embodiment of the invention, this slip formed coping includes both rebars embedded therein and exposed reinforcing bars extending from within the formed/finished coping. These exposed reinforcing bars are suitable for subsequent reinforcement and integration with additional in situ cast concrete structures. so as to further integrate such additional in situ cast concrete structures with the reinforced concrete road structures produced by this process.

2. Description of The Prior Art

Slip forming of concrete structures is a well-known technique for preparation of structural concrete elements for various industrial and public works (road, conduit, etc.) projects. Slip forming is a construction method in which concrete is poured into a continuously moving form. Slip forming is used for tall structures (such as bridges, towers, buildings, and dams), as well as horizontal structures, such as roadways. Slip forming enables continuous, non-interrupted, cast-in-place "flawless", (i.e. no joints), concrete structures which have superior performance characteristics to piecewise construction, using discretely formed elements. Slip forming relies on the quick-setting properties of concrete, and requires a balance between quick-setting capacity and workability, Concrete needs to be workable enough to be placed into the form and consolidated. (via vibration), yet quick-setting enough to emerge from the form with strength (also "self supporting strength" or "green strength"). This green strength is needed because the freshly set concrete must not only permit the form to "slip" upwards/forward. but also support the freshly poured concrete above it ("vertical slip forming") and/or the freshly poured concrete in front of it ("horizontal slip forming").

in vertical slip forming, the concrete on may be surrounded by a platform on which workers stand. placing steel reinforcing rods into the concrete and ensuring a smooth pour. Together. the concrete form and working platform are raised by means of hydraulic jacks. Generally, the slip-form rises at a rate which permits the concrete to harden (develop green strength) by the time it emerges from the bottom of the form. In horizontal slip forming for pavement and traffic separation walls. concrete is laid down, vibrated, worked, and settled in place, while the form itself slowly moves ahead. This method was initially devised and utilized in Interstate Highway construction initiated by the Eisenhower administration during the 1950s.

The following is a representative (and not exhaustive) review of the prior art in this field:

U.S. Pat. No. 3,792,133 (to Goughnour issued Feb. 12, 1974) describes a method and an apparatus for concrete slip forming a highway barrier wall of varying transverse cross-sectional configuration for accommodating different grade levels on opposite sides of the wall, and wherein variations in the wail cross-sectional configuration may be readily accomplished during wail formation without requiring stopping, realignment or other interruptions in the screed movement during wall forming.

U.S. Pat. No. 4,266,917 (to Godbersen issued Mar. 12, 1981) describes a method for the efficient slip forming of highway median barrier wails of differing, size (adjustable height) and shape having any arrangement of linear and curved sections and while the machine is being advanced in a single direction. The lateral adjustability of opposite side walls of the form, relative to the top wall, permits the use of the side walls with top wails of varying widths. The relative vertical adjustment of the top wall and side walls provides for a wide variation in the vertical height of a barrier will particularly where a glare shield is to be formed on the barrier wall top surface. The slip forming of the glare shield takes place simultaneously and continuously with the slip forming of the barrier wall and over any selected portion of the wail while the machine is being advanced in a single direction. At any adjusted position of the slip form, the skirt member associated with each side wall is adjustable to prevent any flow of concrete from between the ground or highway surface and the form.

U.S. Pat. No. 4,084,948 (to Petersik issued Apr. 18, 1978) describes an improved barrier forming apparatus and method whereby a barrier is formed continuously over a surface, the barrier having continuous reinforcing rods extending the length of the barrier and having cagereinforced standard supports at predetermined intervals along the length of the barrier. The Petersik improved barrier forming assembly comprising a concrete forming member having a form cavity extending there through; a concrete passing member having a concrete delivery opening for passing concrete or the like to the fibrin cavity; and a positioning assembly comprising a support shaft and a door Member pivotally supported at a forward end of the concrete forming member, the barrier being extrudable continuously via the form cavity forom a rearward end of the concrete forming member. The door member selectively is positionable to partially seal the form cavity at the forward end of the concrete forming member and has rod clearance channels through which the reinforcing rods pass through the door member into the harm cavity when the door member is so positioned to seal the form cavity. The rod clearance channels permit ie door member to clearingly pass the reinforcing rods to open the form cavity at the forward end of the concrete forming member to allow the free passage of the barrier forming assembly over the cage reinforced standard supports.

U.S. Pat. No. 5,290,492 (to Belarde, issued May 1, 1994) describes a system for continuously forming a concrete Structure (a) having a predetermined cross-sectional configuration, (b) which extends along an elongate path, and (c) includes art outer surface haying a textured pattern comprising concave or convex portions which extend other than just parallel to the elongate path. The system includes a frame, a first form assembly, a second form assembly, a drive system, and a support assembly.

As is evident from the above, there are number of alternatives for the slip forming of structures for use in road and bridge construction, The numerous alternative systems have their proponents and their detractors. In the context of selection of the more appropriate and efficient system, for example, for construction of retainer/barrier walls and/or glare shield concrete structures, time is money and often is reflected in the bidding process. More specifically, the bid letting on highway construction projects routinely include both penalty provisions for tardy completion and/or bonus payments thr early completion. Accordingly, efficiencies Which advance project completion, generally translate into cost saving. Thus, there is continuing efforts to automate, where possible, the fabrication of structural concrete components in highway construction; and, to standardize the process for the fabrication of roadway components and thereby simplify the bid letting on such proiects, particularly federally funded highway construction projects, As is evident from the foregoing, and need not be belabored, the slip forming of structural concrete structures, including, concrete structures for highway construction, is well-known, Invariably, such slip formed highway structures are integrated into roadbeds, used as dividers for road beds and as components for bridges or overpasses for such road beds. The specifications for these concrete structures have and continue to become more uniform and/or have basic specifications in common, because of the advancements in construction methods, and the use of federal funds for such highway construction projects. For example, the specification for a concrete bridge coping must include exposed rehars for the integration into both the road bed, or with a barrier wall, which is to be erected thereupon, and integrated therewith.

Up to now, the standard or generally accepted techniques for the fabrication of bridge coping for an overpass on the highway, have required either the use of a pre-cast coping element (fabricated off-site),, and/or the manual casting of a coping on-site, utilizing traditional forms and concrete casting techniques. In the case of a pre-cast concrete coping element, the road bed of the overpass requires special preparation since the pre-cast element does not readily conform to the angle of incline or grade of a ramp or overpass and, therefore, imperfectly abut one another upon placement on the incline of the bridge overpass. Accordingly, additional installation expense is required to insure the connection of abutting pre-cast copings to one another to insure the formation of a unitary coherent structure.

Alternatively, the casting of an overpass/bridge coping, using the a manual process for forming the coping, specifically, traditional forms and concrete casting techniques, is preferably to the pre-cast coping, because the resulting coping is structurally continuous, and better conforms to the incline/grade of the ramp or overpass. Notwithstanding, the on-site casting, of a bridge coping, by traditional concrete casting technique, is very labor intensive and does not. without an inordinate amount of man power, lend itself to rapid fabrication and accelerated completion schedules. In each of the foregoing alternatives, the coping is formed with extending rebars for the later integration of the coping into a road bed pad and/or the attachment to a retaining wall. which can be later formed on the top of the coping.

Accordingly, there continues to exist the need to both simplify the on-site fabrication of a bridge coping, minimize the manual labor requirements, permit/accommodate accelerated construction schedules, and yet produces a structure which is both coherent (e.g. monolithic structure), and faithfully conforms to the angle of incline or grade of a road overpass, without additional extensive on-site preparation.

OBJECTIVES OF THIS INVENTION

It is the object of this invention to remedy the above, as well as related deficiencies, in the prior art.

More specifically, it is the principle object of this invention to provide a process for slip forming a monolithic, concrete structure having both partially embedded, rebar reinforcement and partially exposed (extending). rebar.

It is another object of this invention to provide a process ter slip forming a monolithic, reinforced concrete structure, which includes a formed. bridge coping, having exposed rebars.

it is yet another object of this invention to provide a process for the slip forming of a monolithic, reinforced concrete structure, which includes a formed road bed pad and a formed bridge coping having exposed rebars It is still yet another of object of this invention to provide a process, which utilizes a tunnel mold assembly, for slip forming a. monolithic, reinforced concrete structure, which includes a formed bridge coping having both partially embedded and partially exposed (extending) exposed rebars.

Additional objects of this invention include a tunnel mold assembly equipped slip forming machine for slip forming a monolithic concrete structure with exposed rebars; and, a tunnel mold for use in the slip forming of a monolithic concrete structure with exposed rebars.

SUMMARY OF THE INVENTION

The above and related objects are achieved by providing a process for the on-site slip forming of a monolithic concrete structure having both partially embedded and partially exposed (extending) rebars. This process is particularly well-suited for the on-site fabrication of a monolithic concrete structure on uneven terrain (ramp) and/or an overpass/bridge grade. This process utilizes an improved slip forming process, in combination with equipment designed specifically for use in this improved slip forming process. In brief, this process combines slip forming with a unique tunnel mold assembly, which is adapted to produce a monolithic, rebar reinforced concrete structure having both partially embedded and partially exposed rebars. These exposed rebars, which extend from within the slip formed, concrete coping, produced in accord with this invention, enable the further integration and union of the slip formed coping, with a concrete retaining wall or other (preferable) concrete structure, or with a guard rail assembly.

The slip forming machinery which is used in the process of the invention includes the traditional concrete handling conveyances, and a unique tunnel mold assembly for forming a reinforced concrete structure with exposed rebars. This tunnel mold assembly includes:

(a) a tunnel mold having at least one channel therein which permits the passage of a rebar through the mold without being encased in concrete.

(b) auger means for essentially uniform distribution of unset concrete within the mold cavity of the tunnel mold and (c) a plurality of vibration means, strategically positioned within the mold cavity of the tunnel mold, for consolidating the unset concrete within the mold cavity and thereby eliminating any voids or lack of continuity within the resultant slip formed structure.

This tunnel mold of this assembly is unique in that it is provided with one or more passages, or channels, which extend through the mold cavity, from the leading/front mold surface to the trailing/rear mold surface of the mold. The dimensions of these channels within the mold cavity is sufficient to accommodate the width and height of exposed rebars, during the in situ fabrication of a slip formed, reinforced concrete structure, such as a the slip formed bridge coping. More specifically, the dimensions of such channels within the mold cavity mold, permits the slip forming of a rebar, reinforced concrete coping, wherein a only a portion of the reinforcing rebars are partially embedded within a slip formed concrete coping, and a portion of the reinforcing rebars remain exposed, (free of concrete), and extend front the slip formed bridge coping, for later integration into a companion structure. The size and number of passages or channels of this tunnel mold is limited, to some extent, by practical constraints—the shape/dimensions of the coping—and engineering factors which dictate the thickness of the concrete which occupies the formed structure which surrounds these exposed rebars.

In the preferred embodiments of this invention, these passages or channels within the tunnel mold, are open at the base of the mold, and correspond in the placement and the extension of the rebars, which are only partially embedded within the slip formed coping. The relative viscosity/rheological properties of the concrete fed into the mold cavity of the tunnel mold (a) limits the configuration of the channels within the mold cavity, and (b) controls/limits the extent to which the concrete can flow from within the mold cavity into these channels. The tunnel mold of the slip forming assembly effectively restricts the extent to which concrete can flow from the mold cavity into these channels, and thereby such channels are maintained essentially concrete free, to accommodate passa rebars through the tunnel mold and remain concrete free.

In another of the preferred embodiments of this invention, the improved process is suitable for concurrent slip forming of multiple structural concrete components, as a monolithic structure. in this preferred embodiment of this invention, the process can be used to concurrently slip form both a bridge coping and a road bed pad, in a single pass of the slip forming equipment, thus, further minimizing the steps and time required for completion of a highway construction project.

In yet an of the preferred embodiments of this invention, the bridge coping, (which is formed in accordance with invention), is further modified, as appropriate, with additional rebar reinforcement, and a slip formed concrete structure, (e,g. noise wall, visual barrier, wall cap, etc.), formed on the top thereof, so as to integrate a latter formed concrete with the slip formed bridge coping, Insofar as the exposed rehar extending from the coping is also thereby integrated into this latter slip formed concrete structure, this latter concrete structure becomes integral with the bridge coping.

DESCRIPTION OF THE INVENTION

INCLUDING PREFERRED EMBODIMENTS

Figure 1:
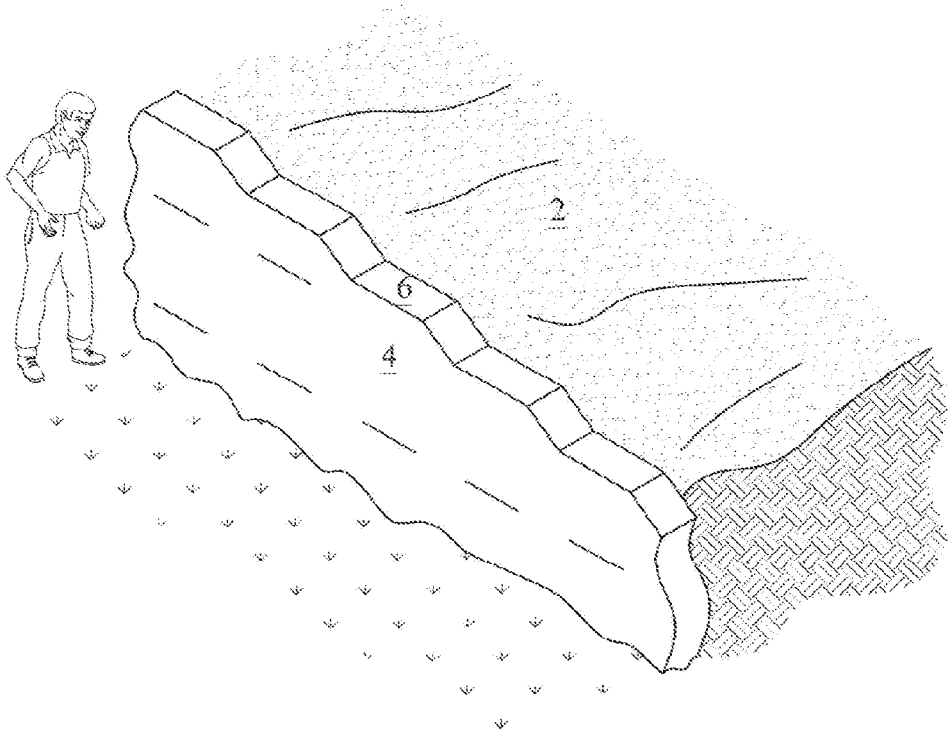
FIG. 1 depicts a perspective view of an inclined road bed, which has yet to be prepared for the addition of a concrete coping or concrete road pad.

As understood within the context of this invention, the following terms and phrases are intended to have the following meaning unless otherwise indicated.

The phrase "slip forming", or "horizontal slip forming", is intended, and used herein, to describe a construction method in which concrete is poured into a continuously moving form. Slip forming is used for tall structures (such as bridges, towers, buildings, and dams), as well as horizontal structures, such as roadways. Slip forming enables continuous, non-interrupted, cast-in-place "flawless" (i.e. no joints) concrete structures, which have superior performance characteristics to piecewise construction using discrete form elements. Slip forming relies on the quick-setting properties of concrete, and requires a balance between quick-setting capacity and workability. Concrete needs to be workable enough to be placed into the form and consolidated (via vibration), yet quick-setting enough to emerge from the form with strength, (also "green strength"), sufficient to be self- supporting because the freshly set concrete must not only permit the form to "slip" forward but also support the freshly poured concrete which now abuts it, as the form continues to move forward.

The term "coping" or "bridge coping" is intended, and used herein, to describe and connote the structural element which is affixed and preferably integral with the top of a retaining wall of an elevated roadway. Within the context of this invention, "coping" and "bridge coping" are fabricated by the improved process of this invention, and have rebars extending from within and partially embedded within the slip formed coping, The slip formed coping prepared in accordance with the process of this invention is thus unique in terms of its fabrication history.

The phrase "road pad" is intended, and used herein, to describe a slip formed concrete slab, which is preferably formed concurrent with the bridge coping. The road pad is used to delineate the lateral margins of the road bed, and is subsequently integral with the road bed. The phrase "tunnel mold" is intended, and used herein, to describe a slip forming compatible assembly, having a one or more channels or passages through the mold cavity and extending from the front (leading edge) to back (trailing edge) of the mold. Each of these channels or passages also have an open end along the base of the mold, which opening extends from the front (leading edge) to back (trailing edge) of the mold, and is of a sufficient height to accommodate the passage of extending rebars, as the they pass through these passages or tunnels, from the front to the back of the tunnel mold, and yet remain concrete-free, as the mold advances forward in the process of slip forming a reinforced concrete structure. The structure which emerges from the tunnel mold has both embedded rebars and concrete free rebars, which extend from rebars embedded in slip formed concrete structure.

The term "rebar" (short for "reinforcing bar"), is intended, and used herein, to describe a steel bar that, is commonly used as a tension device in reinforced concrete, and in reinforced masonry structures, to strengthen and hold the concrete in compression. It is usually in the form of carbon steel bars or wires, and the surfaces may be deformed for a better bond with the concrete.

The abbreviation "MSE" is intended, and used herein, to describe Mechanically Stabilized Earth, constructed with artificial reinforcing MSE walls stabilize unstable slopes and retain the soil on steep slopes and under crest loads. The wall face is often of precast, segmental blocks, panels or geocells, that can tolerate some differential movement. The walls are in-filled with granular soil, with or without reinforcement, while retaining the backfill soil. Reinforced walls utilize horizontal layers typically geogrids The reinforced soil mass, along with the facing, forms the wall. in many types of MSE's, each vertical fascia row is inset, thereby providing individual cells that can be in-filled with topsoil and planted with vegetation to create a green wall.

In the description of the preferred embodiments of this invention, as illustrated in accompanying patent drawings, where an element or feature in one or more Figures is common to more than one of the accompanying patent drawings. it is assigned the same reference numeral for ease of understanding and simplicity of expression.

FIG. 1 is a perspective view of an inclined road bed (2) for an overpass. As is evident from this illustration, the angle of incline, and decline, of the road bed can vary with the grade, and, thus, the preferred method for the fabrication of structural components associated with such inclined road bed are best resolved with on-site fabrication of the structural bridge and road elements. Within the context of this invention, the focus is upon the integration of the structural components for a roadway by means which minimize labor intensive manual labor, and provide for the sequential formation of bridge and overpass components by means of slip forming. The road bed (2) shown in this FIG. 2 has an which has been stabilized by MSE retaining wall (4). The MSF retaining wall (4) shown in FIG. 2 has an unfinished top edge (6), which needs to be integrated into the road bed (2). This integration typically requires the formation of a coping or a comparable structural element, along the unfinished top edge (6) of the MSE retaining wall (4), which, in turn, is further integrated into the finish road bed (not shown).

Figure 2:
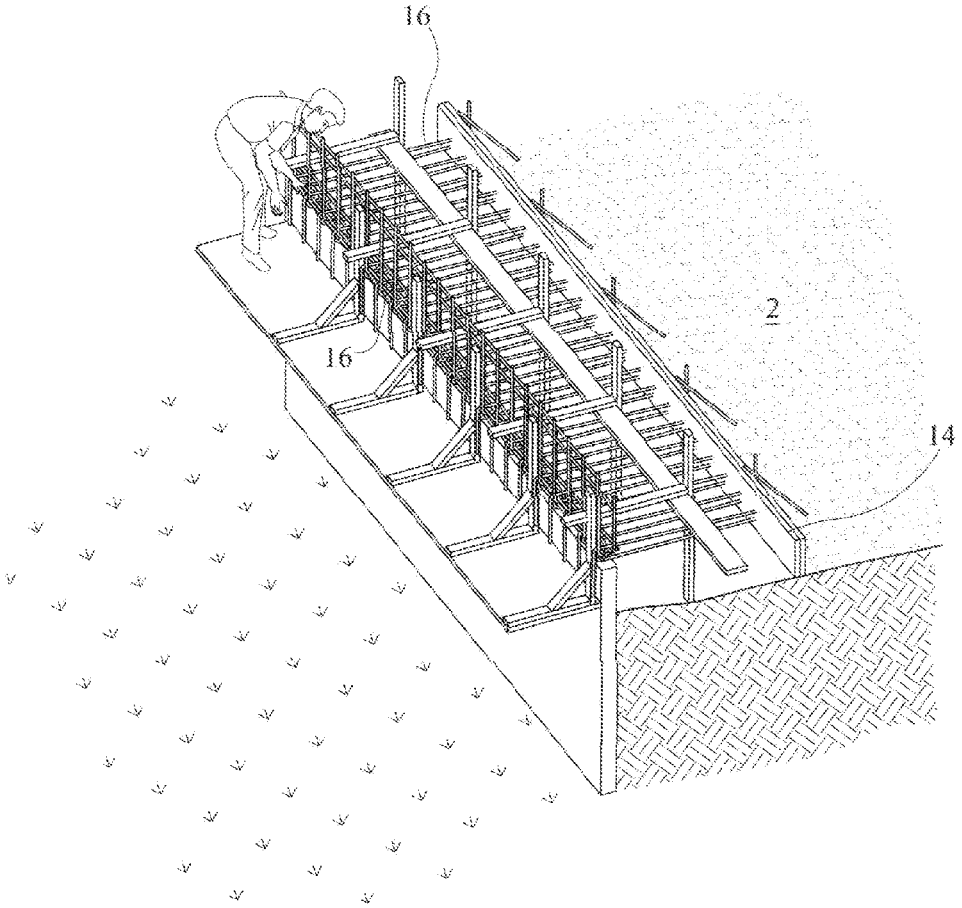
FIG. 2 depicts a perspective view of the custom fabricated forms used in the on-site framing of a coping and road bed pad preliminary to the manual casting of a coping and road bed pad by traditional concrete casting techniques.

FIG. 2 is a perspective view of the traditional, manual on-site preparation for casting of a bridge coping and road pad onto a road bed (2) by conventional concrete casting techniques. In the manual on-site casting of a bridge coping and road pad, extensive manual preparation is required to initially frame a series of forms (14). These forms (14) are used to confine a concrete pour onto an array of iron work reinforcing steel (16). After the cast concrete sets up, the worker thereafter breakdown the forms; and, this manual process repeated for an additional length of coping, until the job is completed. In a typical road construction environment, this process is labor intensive, time consuming, inefficient and very slow because the typical road crew can only fabricate about 40 to 50 feet of traditionally cast product per day. Obviously, the employment of additional manpower on the job will advance the construction schedule somewhat, but be prohibitively expensive and uncompetitive.

Figure 3A:
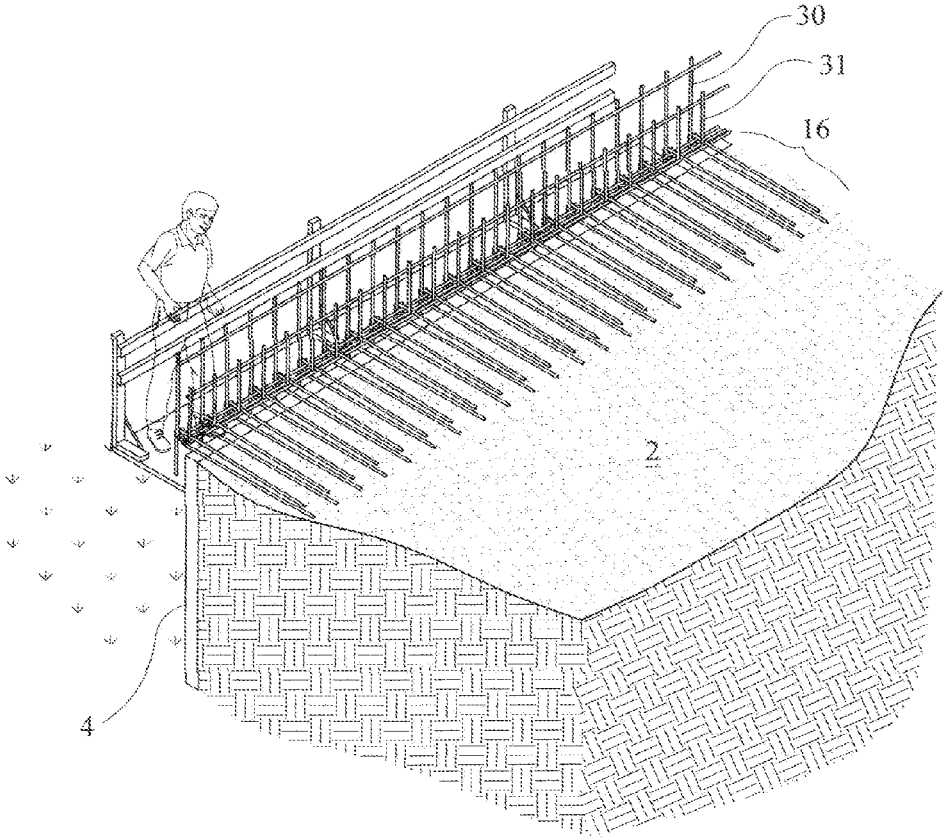
FIG. 3(A) depicts a perspective view of the iron work array on an inclined road bed, prior to the concurrent slip forming of a bridge coping and road bed pad.

FIG. 3(A) depicts a perspective view of the layout of the iron work array (16) for the slip forming of coping and road bed pad on a similar inclined road bed (2) as in FIG. 2, As is evident, the preparation for the slip farming of a coping a road bed pad does not require the use of the tradition series of forms (14). It is emphasized, that the placement of the ironwork array (16) is arrange along the road bed (2) proximate to the MSE retaining wall (4) without structure defining elements (forms). The ironwork array (16) can, and is often fabricated on-site; and, its placement determined by a series of surveyor/reference lines (not shown).

Figure 3B:
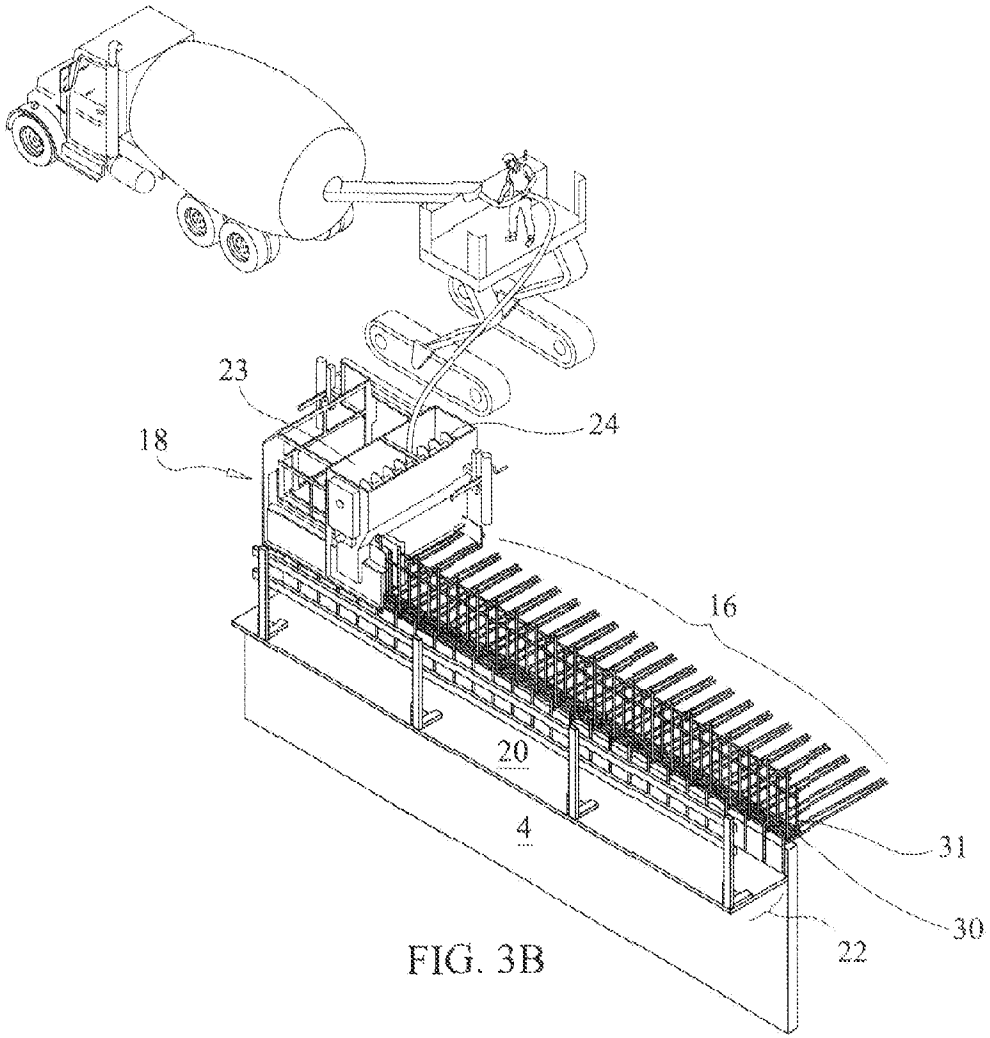
FIG. 3(B) depicts a perspective view of the tunnel mold assembly of this invention. in relation to the iron work array of FIG. 3(A).

FIG. 3(B) depicts placement of a tunnel mold (18) preliminary to the slip forming of a coping and road bed pad upon the ironwork array (16) of FIG. 3A. FIG. (B) shows the iron work array (16), in respect to the MSE retaining wall (4), and a platform (20) which has been erected along the outside (exposed side) of MSE retaining wall (4) to allow for worker oversight of the slip funning process, and to provide a support (22) for a coping along the top of the MSE retaining wall (4), it is noted that the platform (20) is positioned, relative to the iron work array (16), and to the top of tile MSE retaining wall (4), so as to provide a base for a coping, which is to extend over the top of the MSE retaining wall (4), in this FIG. 3(B), the tunnel mold (18) is shown to have an open form cavity (23) and an auger (24).

Figure 3C:
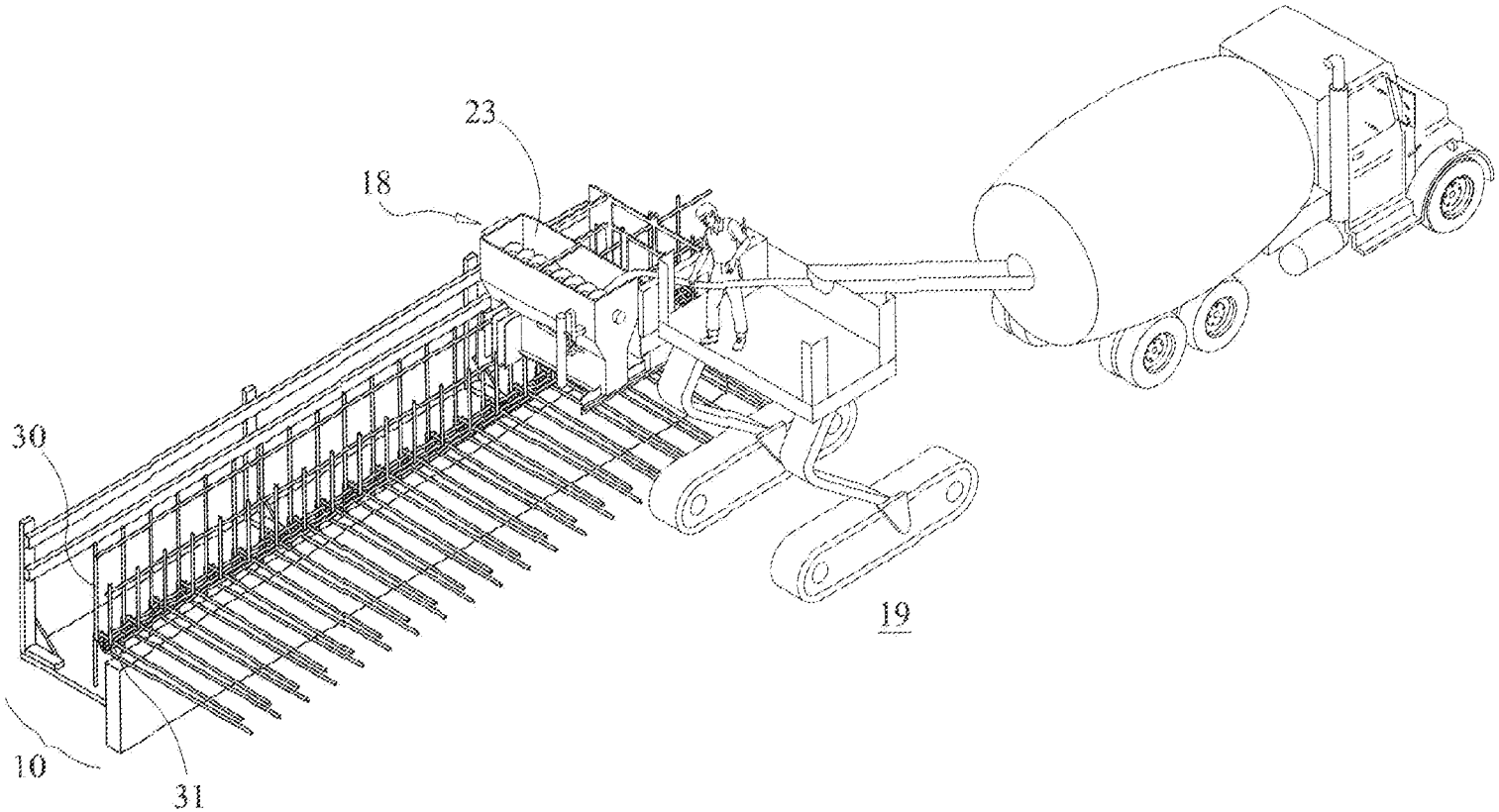
FIG. 3(C) depicts slip forming machinery of this invention in relation to an iron work array Fig, 3(A)

FIG. 3(C) depicts the tunnel mold (18) in combination with slip forming support assembly (19) typically associated therewith. In FIG. 3(C), ready mix concrete is conveyed from a cement mixer to a slip forming support assembly (19), A workman is shown dispensing the relatively fluid concrete mix into the form cavity (23) of the tunnel mold (18). The assembly includes both well-know means for guidance of the assembly relative to the iron work arrays: and, for modulation of the speed of the assembly.

Figure 4A:
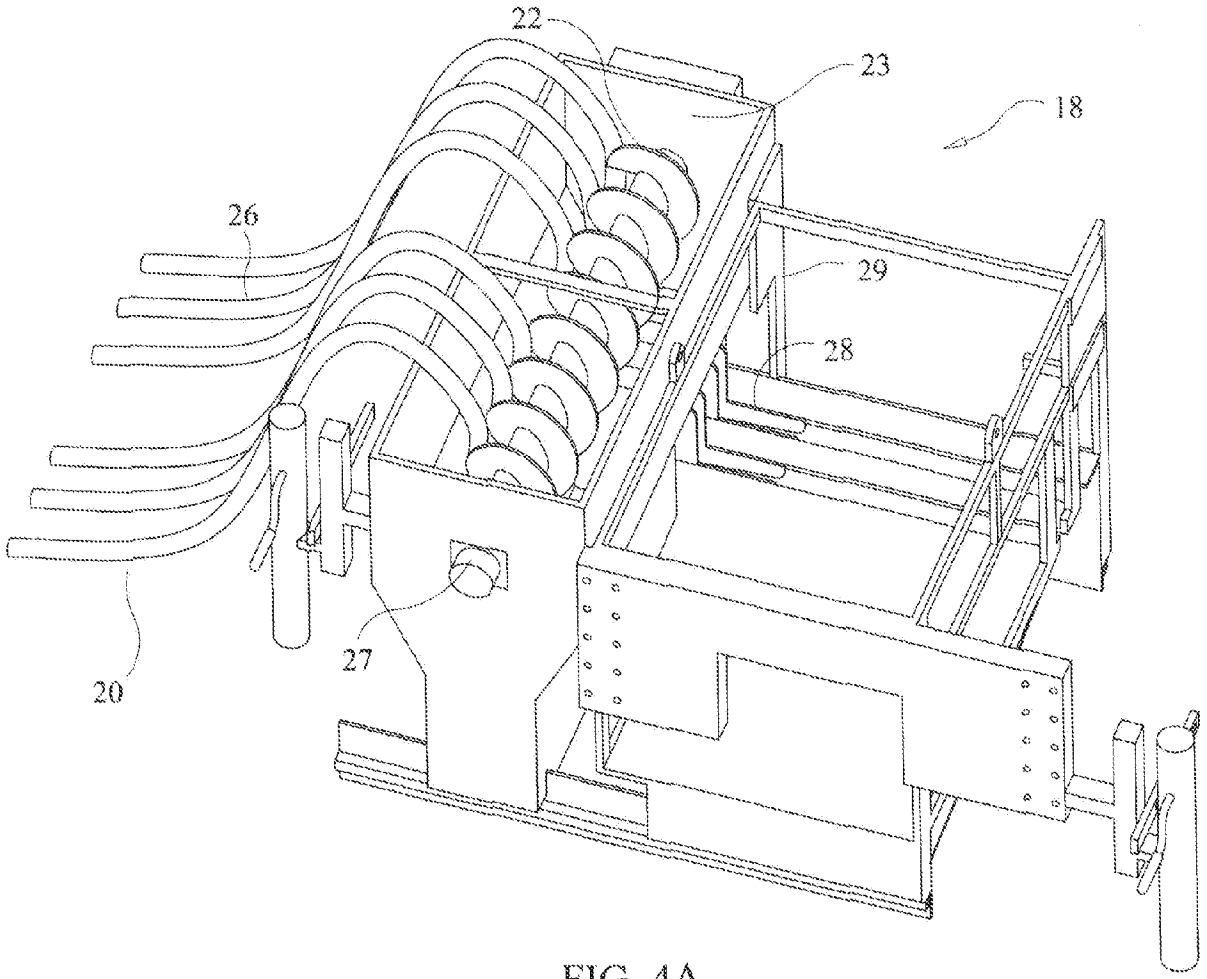
FIG. 4(A) depicts an enlarged view, oot a tunnel mold assembly of this invention, when viewed from above.

FIG. 4 (A) is an isolated and enlarged view of the tunnel mold (18) of FIGS. 3(B) & (C). In FIG. 4(A), the auger (24) is disposed within the form cavity (23) of the tunnel mold (18) along with a series of vibrators (26). Upon the dispensing of a ready mix concrete into the form cavity (23) of the tunnel mold (18), it gradually fills the form cavity (23) until it completely covers the auger (24). The auger (24) is driven by a drive motor (not shown), which rotates an auger drive shaft (27), and thereby effects rotation of the auger and distribution of the concrete across the width of form cavity (23). in practice and operation of the slip forming process, the tunnel mold (18) is progressively advanced over ironwork array (16) of FIG. 3A (from left to right), as a slip formed, concrete coping and a road bed pad are formed upon the iron work array (16), A series of vibrators (26) within the form cavity (23) of tunnel mold assembly (18) effectively consolidates the unset concrete within the form cavity (23), and thereby eliminate any voids or lack of continuity within the resultant slip formed structure. This consolidation of the concrete is essential to the green strength of the formed structure and the continuous forward movement (slipping) of the tunnel mold assembly over the iron work array.

Figure 4B:
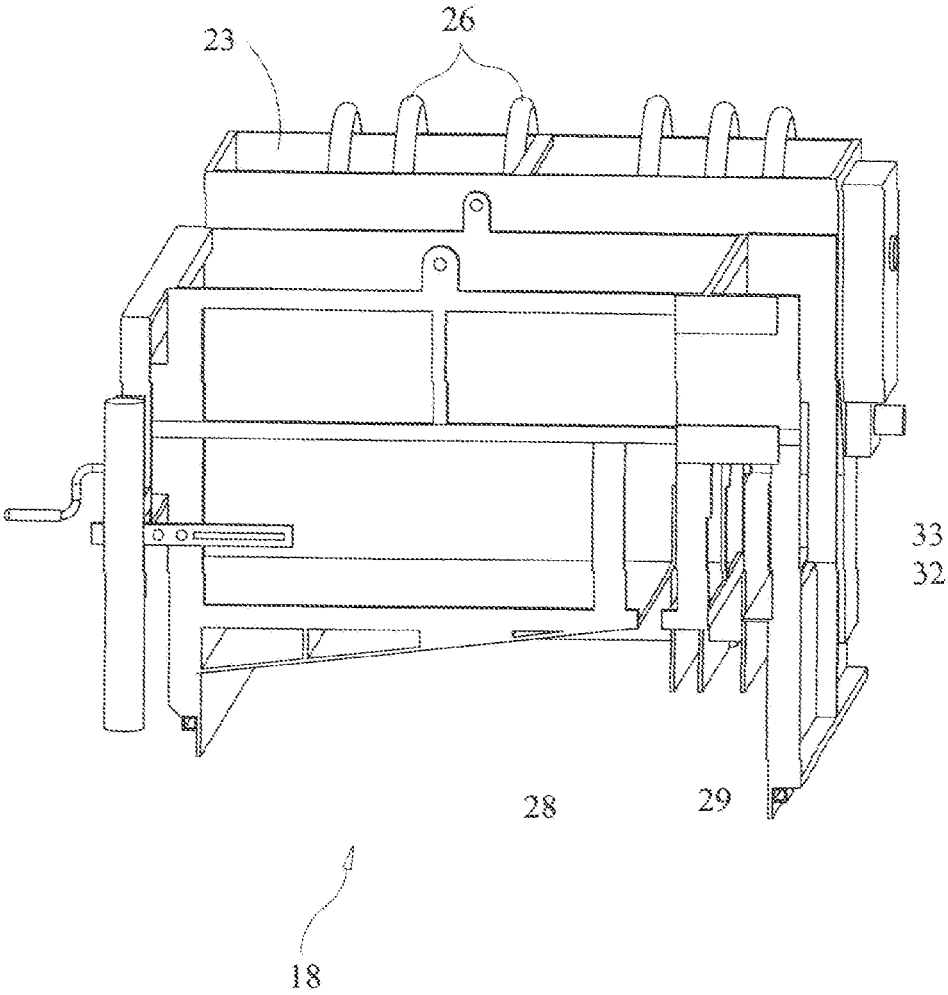
FIG. 4(B) depicts an enlarged view, in partial section, of a tunnel mold assembly of this invention of FIG. 4(A), when viewed from the rear.

FIG. 4(B) is an isolated and enlarged view of the tunnel mold (18) of FIGS. 3(B) & (C).), when viewed from the rear. in FIG. 4(B), the tunnel mold (18) is shown to have two open slots or channels (28, 29), for accommodating the passage a pair of rebars (30, 31), through the tunnel mold (18), without embedding rebars (30, 31) in the concrete, which is dispensed into the form cavity (23) of the tunnel mold (18). Each of channels (28, 29) are further provided with fins (32, 33), which extend from the tunnel mold (18), into the concrete corresponding to the coping (10), to provent/minimizing the flow of unset concrete from the area of the tunnel mold (18), corresponding to coping (10), into channes (28,29), and thereby permitting the formation of a coping (10) with exposed rebars (30, 31). and within the define a hollow insert-like member, which projects into the tunnel mold (18), which extend from the ironwork array (16).

Figure 4C:
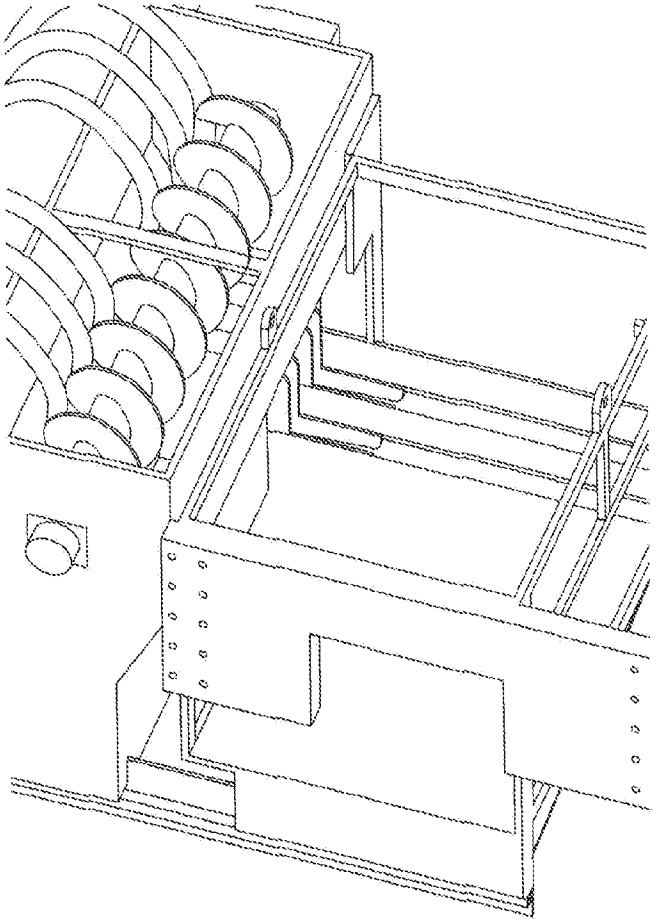
FIG. 4(C) depicts art enlarged view in partial section, of a tunnel mold assembly of this invention of FIG. 4(B).

FIG. 4(C) depicts a partial cutaway of the tunnel mold (18) of FIG. 4(B). The fins (32, 33) are preferably asymmetrical, having greater/deeper extension into the concrete of a formed coping at the forward or leading portion of the tunnel mold (18), and tapering gradually toward the rear of the mold cavity, ultimately withdrawing from the concrete of the formed coping as the tunnel mold (18) progressively moves forward over ironwork array (16) of FIGS. 3A & 3B.

Figure 5A:
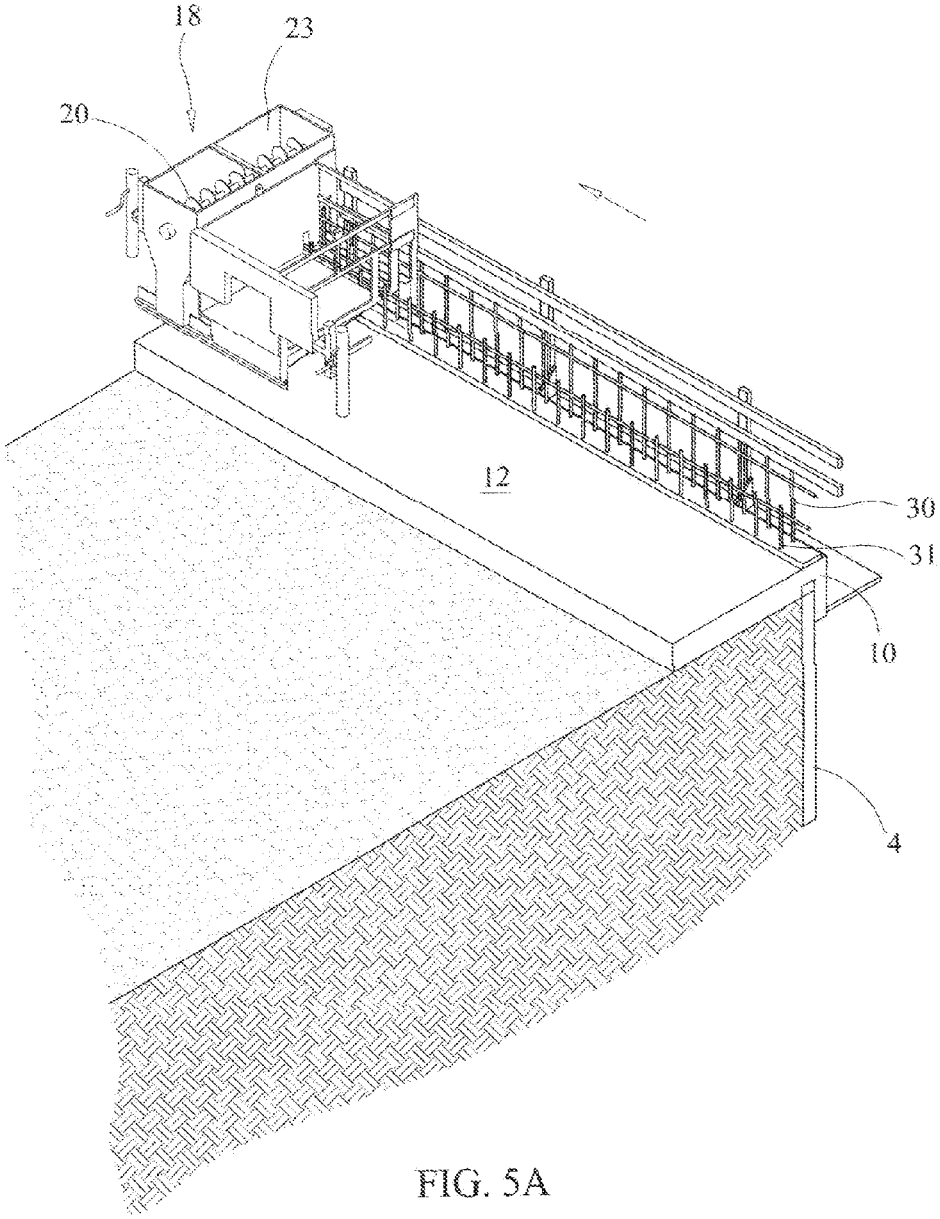
FIG. 5(A) depicts a perspective view of a tunnel mold assembly and slip formed bridge coping and road bed pad, when viewed from the rear of the tunnel mold.

FIG. 5(A) depicts a coping (10) and road pad (12), which have been formed with the tunnel mold (10) of FIG. 3(A) to FIG. 3 (F), in accordance the slip forming process of this invention. As is evident in FIG. 5(A), the coping (10) and road pad. (12) have been slip harmed as a monolithic structure; and, the coping (10) fully engages the top of the MSE retaining wall (4), so as to mechanically couple the MSE retaining wall (4) to the road (road pad (12)). The coping (10) includes extending rebars (30, 31) which can be used to further integrate the coping (10) with other structural road elements.

Figure 5B:
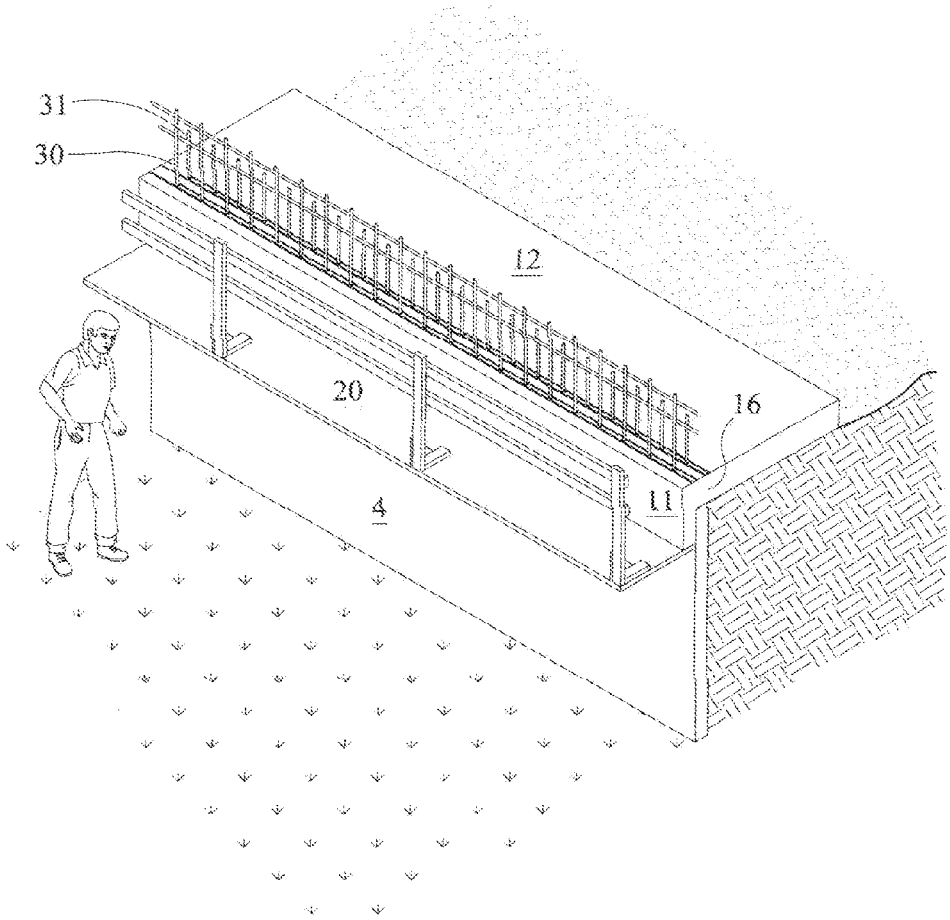
FIG. 5(B) depicts a perspective view of a slip formed bridge coping and road bed pad. when viewed from side of an MSE retaining wall.

FIG. 5(B) depicts a slip formed coping, (10) and road pad (12), when viewed from the side of the MSE retaining wall (4). In FIG. 5(B), the coping (10) extends over the top and down the outside of the MSE retaining wall (4), to the platform., which had been constructed along the side of the MSE retaining wall (4). In this FIG. 5(B), the platform (20) is Shown to have served as a support/form for the base of vertical extension (11) of coping (10), and thereby, the position of the platform (20) relative to the top of the MSE retaning wall (4), defines the length of the vertical extension (11) of the coping (10) proximate to MSE retaining wall (4).

Figure 6A:
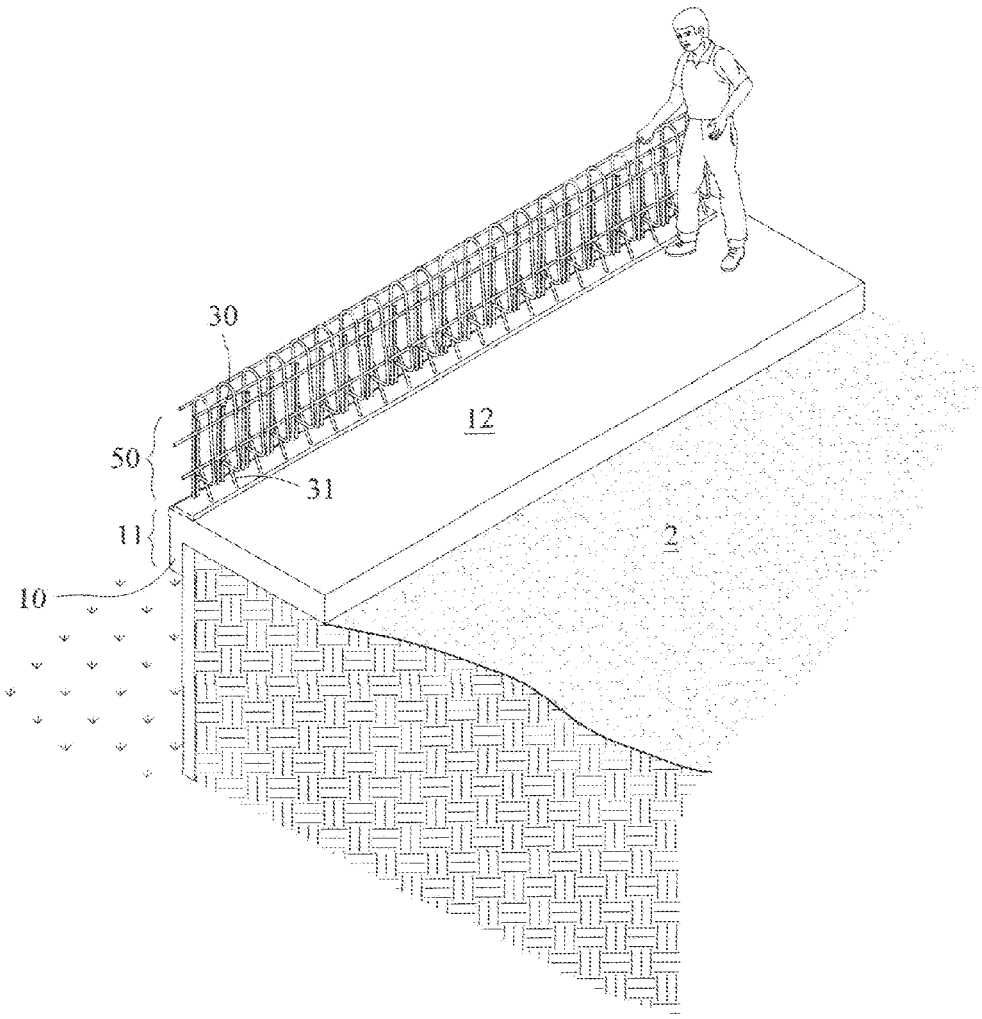
FIG. 6(A) depicts a perspective view of a slip formed bridge coping and road bed pad wherein the extended rebars are physically joined to additional rebars.
Figure 6B:
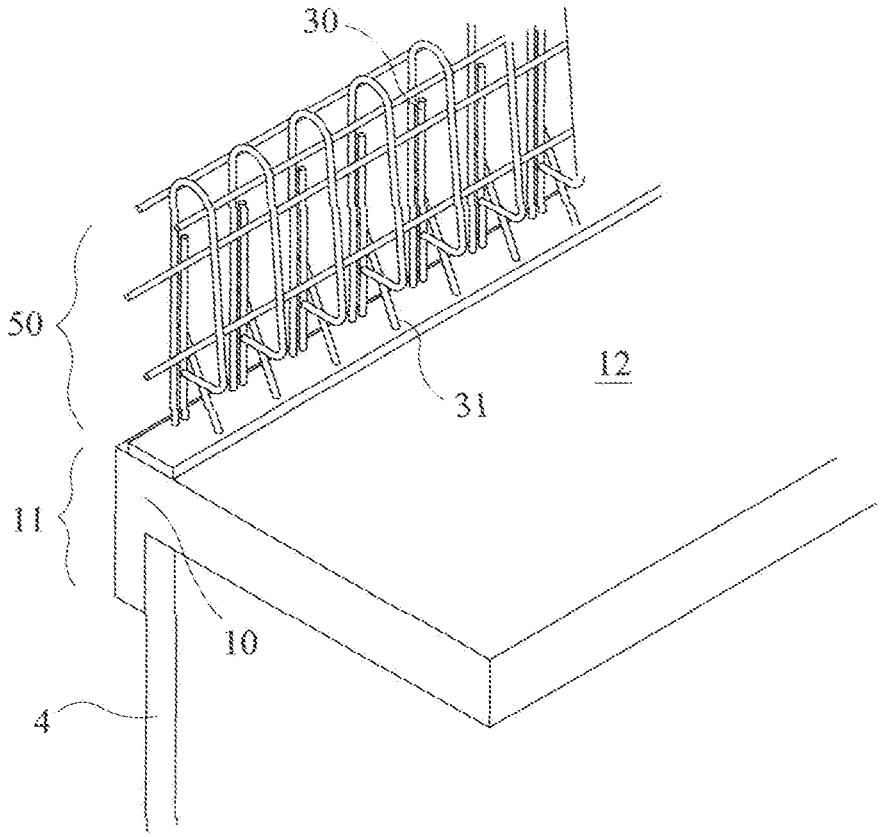
FIG. 6(B) is an enlarged view the extended rebars, from a slip formed bridge coping, physically joined to additional rebars

FIG. 6A depicts a perspective view of the layout of an iron work array (50) for a retaining wall/barrier wall which has been placed on top of the slip formed bridge coping illustrated in FIG. 5(A) and FIG. 5(B) The extending rebars (30, 31) from the slip formed coping (10) and road pad (12), having which have been physically connected to iron work array (50) for retaining wall/barrier wall. FIG 6B is an enlarged view of the extending rebars (30, 31) which have been physically connected to additional reinforcing steel rods. In order to accommodate their physical connection, rebar (31) has been bent prior to the connection to additional reinforcing steel rods. Accordingly, upon Slip, forming of retaining wall/barrier, it shall be structurally reinforced with both exposed rebars (30, 31) from the coping (10), and the iron work array (50) intended for its reinforcement. Thus, the retaining wail/barrier wall, once formed, shall be integrated into the slip formed coping (10).

the foregoing invention has been described m reference to a number of the preferred embodiments of this process for use in the in situ fabrication of concrete structures for highway and bridge construction; and, the resultant concrete structures formed in this process. Both time and space does not permit inclusion all of the potential applications of this process for the formation of monolithic reinforced structures, nor is the invention limited to the concrete and/or rebar reinforcement, Clearly, this process has potential application to the slip formation of reinforced structural shapes having both an embedded reinforcing member and an exposed component Of such reinforcing member. Thus, the scope of this invention is not limited by what has been explicated illustrated and described, but rather defined in the following claims.

What is claimed is:

1. In a process for forming concrete structural components for road and bridge construction, wherein the resultant concrete structural components have exposed rebars for the later integration with additional concrete and/or mechanical structural elements, said additional concrete and/or mechanical structural elements selected from the group consisting essentially of sound walls, harneanes, guard rails and any combination thereof wherein the improvement comprises:

A. Providing an iron work array wherein said iron work array comprises both (1) rebars for embedding within, and reinforcing, a first concrete highway structure and (2) rebars for extending from within said first concrete highway structure, for integration within and reinforcing a second concrete highway structure, to be formed at a later time;

B. Providing a machine assembly having a tunnel mold comprising a mold cavity defined by a plurality of molding surfaces for forming said first concrete structure having. both embedded and exposed rebus, wherein said tunnel mold has a leading or forward molding surface, a trailing or rear molding surface, and at least one elongate channel, through said mold cavity, extending from said leading or forward molding surface to said trailing or rear molding surface of said tunnel mold, said elongate Channel being of a sufficient height to accommodate passage of said extending rebars, through said mold cavity, from said leading or forward molding surface to said trailing or rear molding surface of said tunnel mold;

C. Slip forming said first concrete structure by a. Placing said machine assembly, equipped with said tunnel mold, in slip forming relation to said iron work atray; and b. Introducing concrete into said machine assembly for transfer into said tunnel mold assembly, while continuously moving machine assembly, equipped with said tunnel mold, over said iron work array, to slip thrm a first concrete structure with both rebars embedded in first concrete structure, and concrete free rebars, which extend from said iron work array embedded in said slip formed concrete structure.

2. The slip forming process of claim 1, wherein the tunnel mold has at least two (2) elongate channels through said mold cavity.

3. The slip forming process of claim 1, wherein the tunnel mold assembly includes a plurality vibrating means within said mold cavity to effect consolidation of the concrete within said mold cavity and titerebv eliminate am voids or lack of continuity of said concrete within the resultant slip formed structure.

4. The slip forming process of claim 1, wherein the tunnel mold assembly includes auger means for distribution of concrete within said tunnel mold cavity.

5. The slip forming process of claim 1, wherein the tunnel mold includes a pair of fins associated with each elongate channel and extending therefrom into said unset concrete within said mold cavity, so as to prevent/minimizing unset concrete from flowing from within said mold cavity into each of said elongate channels and covering said rebars which extend into and pass through each of said channel.

6. The slip forming process of claim 1, wherein said iron work array is pre-configured to reinforce a bridge coping.

7. The slip forming process of claim 1, wherein said iron work array is pre-configured to reinforce a bridge coping and is road bed bad.

8. The slip forming process of claim 1, wherein said iron work array is pre-configured to reinforce a bridge coping and a wall to be formed on top of said coping.

9. A system for the slip forming of a reinforced, concrete structure having both embedded and exposed rebars, said system comprising:

A. Providing a machine assembly for continuously molding of a reinforced first concrete highway structure upon an iron word array by slip forming concrete with a tunnel mold, said tunnel mold comprising a mold cavity defined by a plurality of molding surfaces for forming said first concrete structure on said iron work array, wherein said tunnel mold has a leading or forward molding surface, a trailing or rear molding surface, a mold cavity and at least one elongate channel, through said mold cavity, said elongate channel being of a sufficient height to accommodate passage of said extending rebars, through said mold cavity, from said leading or forward molding surface to said trailing or rear molding surface of said tunnel mold;

B. Means for transfer of unset concrete into said tunnel mold assembly, while continuously moving machine assembly, equipped with said tunnel mold, over said iron work array, to slip form a first concrete structure with both rehars embedded in said first concrete structure, and concrete free rebars, which extend from said iron work array embedded in said slip formed concrete structure; and C. Means for guidance and control of movement over said machine assembly relative to said iron work array.

10. system of claim 9, wherein the tunnel mold has at least two (2) elongate channels through said mold cavity.

11. system of claim 9, wherein the tunnel mold assembly includes a plurality vibrating means within said mold cavity to effect consolidation of the concrete within said mold cavity and thereby eliminate any voids or lack of continuity o said concrete within the reultant slip formed structure.

12. The system of claim 9, wherein the tunnel mold assembly includes auger means for distribution of concrete within said tunnel mold cavity.

13. The system of claim 9, wherein the tunnel mold includes a pair of fins associated with each elongate channel and extending therefrom into said unset concrete within said mold cavity, so as to prevent/iminimizing unset concrete from flowing from within said mold cavity into each of said elongate channels and covering said rebars which extend into and pass through each of said channel.

14. The system of claim 9,, wherein said iron work array is pre-configured to reinforce a bridge coping.

15. The system of claim 9, wherein said iron work array is pre-configured to reinforce a bridge coping and a road bed.

16. The system of claim 9, wherein said iron work array is pre-configured to reinforce a bridge coping and a wall to be formed on top of said coping.

* * * * *